United States Patent [19]

Jackson et al.

[11] 3,996,885

[45] Dec. 14, 1976

[54] APPARATUS FOR COATING A MULTIPLE NUMBER OF LAYERS ONTO A SUBSTRATE

[75] Inventors: Brian W. Jackson, London, England; Dean E. Winkler; Charles B. Woodworth, both of Rochester, N.Y.

[73] Assignee: Eastman Kodak Company, Rochester, N.Y.

[22] Filed: June 19, 1975

[21] Appl. No.: 588,261

Related U.S. Application Data

[62] Division of Ser. No. 327,048, Jan. 26, 1973, Pat. No. 3,928,679.

[52] U.S. Cl. ..... 118/50; 118/411

[51] Int. Cl.[2] ..... B05C 5/02

[58] Field of Search ..... 118/407, 411, 412, 50; 96/87 R

[56] References Cited

UNITED STATES PATENTS

| | | | |
|---|---|---|---|
| 2,761,417 | 9/1956 | Russell et al. | 118/412 X |
| 2,975,754 | 3/1961 | Wright | 118/407 |
| 3,627,564 | 12/1971 | Mercier | 118/412 X |
| 3,916,043 | 10/1975 | Fowble | 96/87 R X |

*Primary Examiner*—John P. McIntosh
*Attorney, Agent, or Firm*—A. P. Lorenzo

[57] ABSTRACT

An improved extrusion-slide coating hopper for multilayer coating of a substrate is described. The improved extrusion-slide coating hopper includes an upturned generally horizontally directed lip, which lip extends at an obtuse angle from an inclined slide surface and toward the substrate to be coated. A coating composition may be made to flow down the inclined slide and then upon the generally horizontally directed lip before being introduced on top of an extruded bridge of coating composition. The bridge of coating composition spans a generally horizontal gap between the hopper and the upwardly moving substrate. The apparatus of the invention improves upon coating apparatus of the prior art by providing, when coating, increased bridge stability and minimization of the deleterious effects of particles that lodge at an edge of the hopper.

14 Claims, 2 Drawing Figures

APPARATUS FOR COATING A MULTIPLE NUMBER OF LAYERS ONTO A SUBSTRATE

This is a division of application Ser. No. 327,048, filed Jan. 26, 1973 and issued Dec. 23, 1975 as U.S. Pat. No. 3,928,679,

CROSS-REFERENCE TO RELATED APPLICATIONS

This application is related to commonly assigned U.S. application Ser. No. 326,621, filed Jan. 26 1973and issued Dec. 23, 1975 as U.S. Pat. No. 3,928,678 and to commonly assigned U.S. application Ser. No. 588,260 filed June 19, 1975 as a division of application Ser. No. 326,621.

BACKGROUND OF THE INVENTION

1. Field of the Invention

This invention relates to improvements in coating apparatus wherein two or more coating compositions are simultaneously applied to a substrate, such as, say, a web.

2. Description of the Prior Art

In the prior art, as represented by U.S. Pat. Nos. 2,761,417 and 2,761,791, filed in the names of Russell et al. —the contents of which patents are herein incorporated by reference —it is known to simultaneously coat a moving substrate, for example, a photographic film base with varios coating compositions, by the use of a coating hopper which includes one or more outlets for extruding one or more layers directly into a bead from which the substrate is coated in combination with one or more slide surfaces upon which one or more layers flow before being fed into the bead.

The slide portion of the hopper may include one or more separate exit slots, whereby respective liquid coating compositions may be metered from individual supplies and distributed uniformly across respective inclined slide surfaces. Each of the respective compositions flows by gravity as a layer down its respective inclined surface, whereby the layer becomes smooth and of uniform thickness. Where the hopper includes more than one slide surface, the slike surfaces are arranged so that the layers flow on top of one another. At the end of the lowermost slide surface, i.e., the one adjacent to the extrusion outlet(s), the one or more layers flow on top of a bridge of liquid that is established by liquid coating composition from the extruder portion of the hopper. The bridge of liquid coating composition from the extruder portion spans the generally horizontal gap between an outlet edge of the extruder portion of the coating hopper and the generally upwardly moving substrate. The layer(s) of coating composition from the slide surface(s) thus flow over the bridge, and the substrate, as it is advanced into contact with the bridge, simultaneously picks up all the coating compositions from the extruder and the slide surface(s) and these compositions deposit on the substrate as a composite coating of substantially distinct superimposed layers.

While the apparatus function satisfactorily, various defects can arise in the coated layers of certain products if the bridge is disturbed. For example, a particularly noticeable fault is the appearance of longitudinal striations which render the coated web totally unacceptable as a commercial photographic product. The presence of these longitudinal striations tends to increase rapidly as the web coating speed is increased.

Furthermore, as disclosed in the afore-mentioned patent, and in U.S. Pat. No. 2,681,294,—the contents of which are also incorporated by reference —it is advantageous to create a pressure differential between the exposed surfaces of the bridge, such as by the creation of a vacuum on the trailing surface of the bridge to eliminate excessive vibration and/or rupture of the bridge. The range of vacuum levels which may be used is, of course, limited as, if it is too great, the high pressure differential across the bridge may also cause the bridge to be disturbed and/or ruptured. At times, it may develop that the amount of vacuum being used is insufficient to eliminate the excessive vibration in the bridge, and thus it is desirable to increase the amount of such vacuum. Where an increase in vacuum will itself cause disturbance and/or rupture of the bridge, it is sometimes necessary to change coating conditions, such as by lowering web speed, to make satisfactory coatings.

A further problem with the use of the coating hopper described in the afore-mentioned Russell patents is that particles in the liquid coating composition may adhere to the hopper at the lip edge thereof and cause undesirable streaks to be formed in the coating. An apparatus which reduces or minimizes the deleterious effects of such particles on coatings represents a significant contribution to the state of the art.

SUMMARY OF THE INVENTION

It is therefore one object of the invention to provide an improved apparatus of the type described herein for coating a moving substrate at higher speeds with minimum disturbance during coating.

It is a further object of the invention to provide an improved apparatus of the type described herein for coating a moving substrate which minimizes the undesirable effects of particles which adhere to a lip of the coating apparatus.

In the apparatus of the invention, a multiple-layer coating hopper is provided with an extrusion outlet through which one or more layers of liquid coating composition(s), are extruded directly into a bridge of coating composition(s), which bridge spans a generally horizontal gap between the hopper and an upwardly moving substrate to be coated. The hopper is further provided with a downwardly inclined slide surface upon which one or more layers of liquid coating composition(s) are made to flow so the layers become smooth and of uniform thickness. At the end of the slide surface, a lip is provided which extends toward the substrate at an obtuse angle relative to the slide surface and the layer(s) of coating composition(s) may flow upon this lip before being fed into the bridge of coating composition(s).

DESCRIPTION OF THE PREFERRED EMBODIMENT

Figure 1:
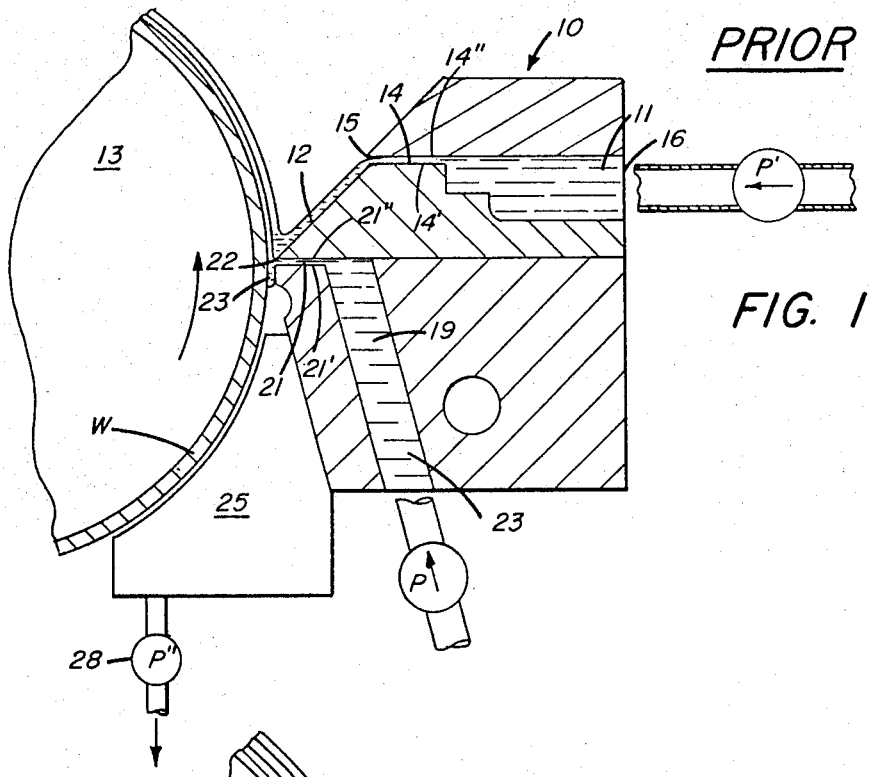
FIG. 1 is a side view, partly in section, showing a coating apparatus including a multiple-layer extrusion-slide hopper as known in the prior art.

In the prior art coating apparatus, such as disclosed in U.S. Pat. No. 2,761,417 and shown herein in FIG. 1 a substrate, such as web W, is supported on and advanced past a coating hopper 10 by a driven coating roller 13. The web may be paper, metal, or plastic film, and may include one or more substantially dry coatings previously applied thereto. For illustrative purposes, the hopper 10 is shown as being adapted to coat two layers simultaneously. To coat such layers, metering pumps P and P′ are coupled to respective sources of fluid coating compositions and feed the compositions 16,23 at desired rates into respective cavities 11,19 formed in the interior of hopper 10. The compositions 16,23 are each then forced to flow as a ribbon through narrow discharge slots 14,21 respectively, each of which slots at one end extends into the interior of the hopper to a respective cavity and at the other end terminates in an exit 15,22 respectively. The discharge slots 14,21 are each defined by a pair of opposed closely-spaced parallel planar surfaces 14′,14″; 21′,21″ respectively. The substrate W is supported on the roller 13 proximate to exit 22 so that an extruded bridge of the coating composition 23 may be formed, which bridge spans the space between the exit 22 and the surface of the substrate W to be coated. The exit 15 of discharge slot 14 is located adjacent to and above a downwardly inclined planar slide surface 12. The coating composition 16 is adapted to flow upon the planar slide surface 12 so as to become smooth and of uniform thickness. The lower tranverse edge of slide 12 is located proximate to the exit 22 of slot 21 and it may be noted that slide surface 12 is inclined at an acute angle relative to discharge slot 21. As the layer of coating composition 16 leaves the lower edge of slide 12, it flows into the bridge and both coating compositions 16,23 are picked up by the generally upwardly moving substrate W as it is rapidly advanced past the bridge. The coating compositions 16,23 deposit onto a surface of the substrate W as a composite coating of substantially distinct superimposed layers. As used herein, a web or substrate is generally upwardly moving at a point where at such point its vertical component of velocity is greater in magnitude that its horizontal component of velocity.

To stabilize the bridge, suction or a vacuum may be employed on the trailing surface of the bridge to establish a pressure differential between the exposed surfaces of the bridge. The suction may be provided by a chamber 25 that is coupled to a vacuum pump P″, 28, to exhaust air from the chamber 25.

Figure 2:
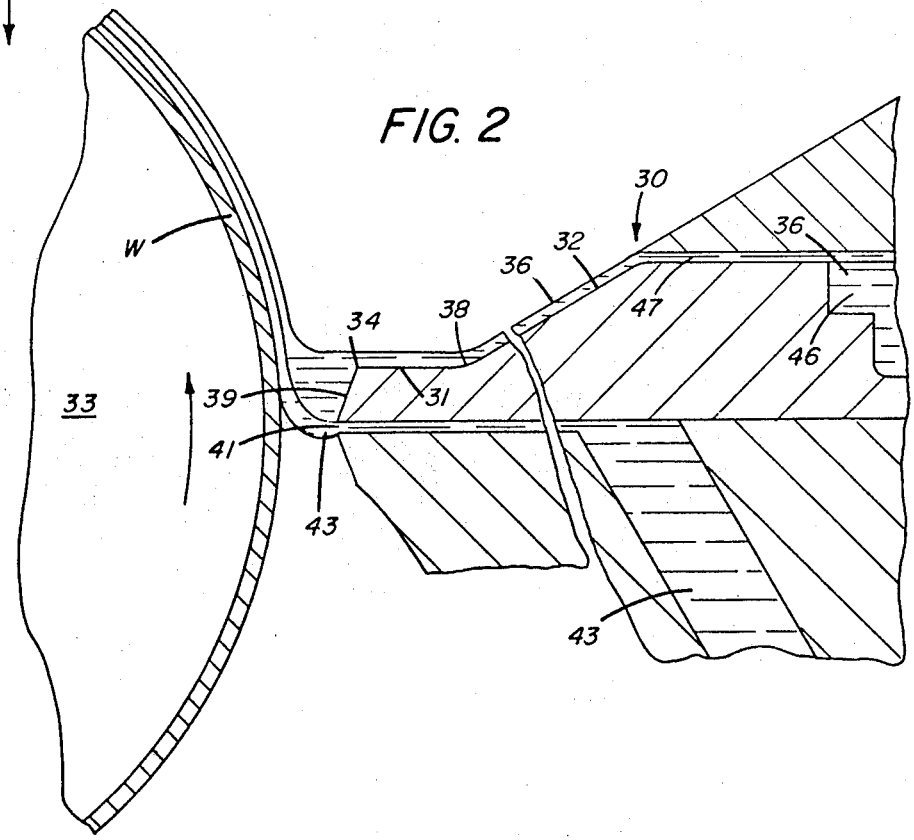
FIG. 2 is a close-up side view of an improved coating apparatus made in accordance with the invention, the portion of the hopper closest to the web being shown greatly magnified relative to the coating roller and the remainder of the hopper.

In FIG. 2, a portion of an improved extrusion-slide hopper 30 made in accordance with the present invention is shown. For purposes of clarity, the suction chamber has been deleted from the apparatus shown in FIG. 2, but such pressure differential establishing means is advantageous when used in conjunction with the apparatus of the invention. The hopper shown in FIG. 2 is similar in most respects to that shown in FIG. 1, but differs in that it includes a rigid upturned lip 31 which extends at an obtuse angle from the lower end of the slide surface 32 toward the surface of a generally upwardly moving substrate W, e.g., the web, being coated. The lip 31 is preferably generally planar and of the same transverse width as the planar slide 32 and terminates in a transverse edge 34, defined by the planar land of the lip 31 and side face 39 of the extruder outlet 41. The lip 31 may be formed on the apparatus of the prior art by machining, and in forming the lip it is preferred to round, as shown in FIG. 2, the obtuse angle 38 formed between the lip surface 31 and slide surface 32.

Extrusion outlet 41 is spaced generally horizontally from the coating roller 33 a distance slightly greater than the thickness of the web W, to be coated so as to establish in operation of the hopper an extruded bridge of liquid coating composition 43, which bridge spans the gap between the hopper and the surface of the web W. Preferably, the gap between outlet 41 and the surface of the web being coated is between about 0.005 (0.13 mm) inches to about 0.03 (0.76 mm) inches. As may be noted from FIG. 2, the liquid coating composition 36, after being forced from cavity 46 and through narrow metering slot 47, flows downwardly upon the slide surface 32, then along the gnerally horizontally directed rigid lip 31 and into the bridge of coating compositions. The slide surface 32 is inclined relative to the horizontal at a desired angle that is preferably greater than ten degrees and less than 45 degrees, depending upon the properties of the liquid composition being coated. As the lip 31 is of lesser inclination to the horizontal than that of the slide surface 32, the layer of coating composition 36 flows over the lip with reduced speed, but increased thickness (depth). The increased thickness of the layer on the upturned lip 31 is advantageous in that the effects of any particles that happen to lodge at edge 34 may be minimized by a "dilution" of such effects by the thicker layers on the upturned lip, i.e., a particle of a certain size that is lodged on the edge 34 will tend to create a greater disturbance in a thin (shallow) liquid, as opposed to a thicker (deep) liquid, as the liquid is flowed past the particle. The lip 31 is directed in a generally horizontal direction, and is preferably horizontal, although it may be inclined relative to the horizontal in the direction of liquid flow within the preferred range of $\pm 5°$. The length of the lip 31 in the direction of liquid flow is advantageously in the range of about 0.025 to 0.080 inches (0.06 cm to 0.21 cm), and is preferably about 0.040 inches (0.10 cm). Such dimensions are advantageous in the coating of photographic compositions wherein coatings might vary between a dry thickness of 0.0001 to 0.001 inches and protective layers separating such coatings might be as thin as one micron.

With the use of the coating roller 33 to support the web in a smooth condition, it is desirable to have the point of application of the liquid bridge to the web, W, be within a preferred acute angular range of "application points", and such preferred range is from about a point on the web that is located at about 40° below the horizontal radius of the coating roller 33 vertically to about 30° above siad horizontal raduis. The generally horizontal gap is advantageous in that it allows gravity to act on the suspending bridge of coating liquids and facilitates the formation of the bridge.

In the prior art apparatus of FIG. 1, one factor which may contribute to the inability of the bridge of liquid coating compositions at times to withstand higher pressure differentials is that the bridge must, in addition to the pressure differential across it, support itself against the force of the downwardly rushing liquid layer(s) which is continuously feeding into the bridge.

The introduction of the coating compositions into the bridge along the generally horizontal plane of the lip 31 apparently is able to reduce the force of the liquid rushing into the bridge or otherwise increase the stability of the bridge so that increased suction levels may be used on the bridge at high coating speeds without encountering disturbances that produce unsatisfactory coatings. Furthermore, even at the sam suction levels, increased coating speeds may be obtained using the apparatus and method of the present invention over that shown in the Russell et al. patent.

To illustrate the advantages of the invention, two superimposed layers may be simultaneously coated using in one instance a coating hopper embodying the invention, such as that shown in FIG. 2. The lower layer of liquid coating composition may have a viscosity of 350 centipoise and a wet laydown of 0.68 pounds per hundred square feet. The upper layer of liquid coating composition may have a viscosity of 350 centipoise and a wet laydown of 2.8 pounds per hundred square feet. Suction may be maintained across the bridge during coating with a gap between the extrusion outlet and the web of about 0.010 inches. It was found that in coating at high speeds, striations in certain coatings due to instability of the bridge, and which striations are present with the use of similar coating apparatus of the prior art are absent in such coatings when using the apparatus and method of the invention.

The invention may also be embodied in extrusion slide hoppers other than that specifically described herein. For example, the extrusion portion of the hopper may be comprised of more than one extruder outlet, such as shown in FIG. 3 of the afore-mentioned U.S. Pat. No. 2,761,417. Also, the hopper may be comprised of more than one slide surface arranged one above the other so that each of two or more layers may be fed along its respective slide surface before it flows in superimposed fashion with the other layers along the lower-most slide surface and the upturned lip. An example of such a hopper, which may be modified in accordance with the present invention, is shown in FIG. 4 of the U.S. Pat. No. 2,761,417.

The apparatus of this invention can be utilized to coat materials or mixtures of materials which can be put in liquid form and coated, for example, in the form of a solution, dispersion, or a suspension. In many instances where this apparatus finds application, the coating composition preferably comprises an organic solvent coating composition, but other liquid vehicles of either inorganic, such as aqueous, nature, can also be utilized and are fully within the contemplation of this invention. The respective layers can be formed of the same or different liquid coating compositions, and these coating compositions can be either miscible or immiscible with one another. High viscosity polymeric layers may be advantageously coated with the apparatus of the invention using aqueous or organic vehicles.

In addition to use in the manufacture of photographic elements, the apparatus of this invention finds application in many other areas of the coating art, where one or more coated layers in which one or more separate layers of different compositions are desired to impart particular properties to a product.

The apparatus of the invention is particularly useful in multiple-layer coating, where it is desired that the upper layer have a relatively high coverage (pounds per square foot) relative to the lower layer.

It will be appreciated from the above that the invention provides an improved apparatus which may be used to coat a web at increased speeds. It will be further appreciated that such apparatus embodying the invention claimed herein may be made relatively inexpensively by modifying coating hoppers of the prior art without the need even for changing the mountings for such apparatus.

The invention has been described in detail with particular reference to preferred embodiments thereof, but it will be understood that variations and modifications can be effected within the spirit and scope of the invention.

We claim:

1. An apparatus for simultaneously coating at least two layers of liquid coating compositions onto a surface of a substrate, said apparatus comprising:

means for defining an extrusion slot having an extrusion outlet adapted to be located in proximately spaced relationship relative to the substrate so that an unsupported bridge of a first liquid coating composition may be extruded through said slot to span the gap between said outlet and the substrate;

means for defining a downwardly inclined planar slide surface upon which a second liquid coating conposition is adapted to flow as a layer before being coated on the substrate, said slide surface being located above said extrusion slot and being directed at an acute angle relative thereto;

means for defining an exit opening located adjacent the upper end of said slide surface through which the second liquid coating composition is adapted to pass before being deposited onto said planar slide surface; and means for defining a rigid lip portion which extends from and is continuous with the lower end of said planar slide surface and is adapted to have the second liquid coating composition flow thereon, said lip portion being directed in the direction of liquid flow at an angle of lesser inclination to the horizontal than that of said planar slide surface, and said lip portion being located proximate to and generally above said extrusion outlet so that the coating composition on said slide surface is adapted to flow into the bridge of coating composition between said extrusion outlet and the substrate.

2. The invention according to claim 1 wherein the length of said lip portion in the direction of liquid flow is between 0.025 and 0.080 inches.

3. The invention according to claim 1 wherein said lip portion comprises a generally horizontal, generally planar surface.

4. The invention according to claim 3 wherein the lip portion is oriented in the direction of liquid flow within the range of $\pm 5°$ relative to the horizontal.

5. The invention according to claim 4 wherein the length of said lip portion in the direction of liquid flow is between 0.025 and 0.080 inches.

6. The invention according to claim 5 wherein said exit opening has associated therewith means defining a narrow metering slot for metering said second coating composition before said coating composition is deposited onto said slide surface; and means for defining a cavity into which said second coating composition may be delivered before being metered through said metering slot.

7. The invention according to claim 6 and including means for supporting said substrate proximate to and generally horizontally spaced from said lip portion and for generally vertically moving said substrate across and into contact with said bridge of liquid coating compositions so that the surface of the substrate picks up the layers of liquid coating compositions in superimposed substantially distinct layered relationship.

8. An apparatus for simultaneously coating at least two layers of liquid coating compositions onto a surface of a substrate, said apparatus comprising:

means for defining an extrusion slot having an extrusion outlet adapted to be located in proximately spaced relationship relative to the substrate so that an unsupported bridge of liquid coating composition may be extruded through said slot to span the gap between said outlet and the substrate;

means for defining a downwardly inclined planar slide surface upon which a second liquid coating composition is adapted to flow as a layer before being coated on the substrate, said slide surface being located above said extrusion slot and being directed at an acute angle relative thereto;

means for defining an exit opening located adjacent the upper end of said slide surface through which the second liquid coating composition is adapted to pass before being deposited onto said planar slide surface;

means for defining a rigid lip portion which extends from and is continuous with the lower end of said planar slide surface and is adapted to have the second liquid coating composition flow thereon, said lip portion being directed in the direction of liquid flow at an angle of lesser inclination to the horizontal than that of said planar slide surface, and said lip portion being located proximate to and generally above said extrusion outlet so that the coating composition on said slide surface is adapted to flow upon the bridge of coating composition between said extrusion outlet and the substrate; and means for supporting said substrate proximate to and generally horizontally spaced from said lip portion and for generally vertically moving said substrate across and into contact with said bridge of liquid coating compositions so that the surface of the substrate picks up the one or more layers of liquid coating composition in superimposed substantially distinct layered relationship.

9. The invention according to claim 8 wherein the length of said lip portion in the direction of liquid flow is between 0.025 and 0.080 inches.

10. The invention according to claim 8 wherein said lip portion comprises a generally horizontal, generally planar surface.

11. The invention according to claim 10 wherein said lip portion is oriented in the direction of liquid flow within the range of ±5° relative to the horizontal.

12. The invention according to claim 11 wherein the length of said lip portion in the direction of liquid flow is between 0.025 and 0.080 inches.

13. The invention according to claim 12 wherein said exit opening has associated therewith means defining a narrow metering slot for metering a respective coating composition before said coating composition is deposited on its respective slide surface; and means defining a cavity into which said respective coating composition may be delivered before being metered through said metering slot; and wherein said means for supporting said substrate comprises a generally horizontally extending roller about which said substrate is at least partially wrapped, said lip portion being so located relative to the substrate wrapped on said roller so as to apply said coating compositions onto the substrate at an application point located within the range of application points between about 42° below a horizontal radius of the roller upwardly to about 30° above the horizontal radius of the roller.

14. The invention according to claim 13 and including means for establishing a pressure differential between the exposed surfaces of the bridge so that a relatively lower pressure is created adjacent the trailing surface of the bridge.

* * * * *